United States Patent [19]

Cobb

[11] 4,364,200

[45] Dec. 21, 1982

[54] AUTOMATICALLY OPERABLE AUTOMOTIVE VEHICLE GATE APPARATUS PROVIDED WITH SELF PROTECTION AND AUTOMOTIVE PROTECTION

[75] Inventor: Carl W. E. Cobb, Centerville, Ohio

[73] Assignee: Kettering Medical Center, Kettering, Ohio

[21] Appl. No.: 220,358

[22] Filed: Dec. 29, 1980

[51] Int. Cl.[3] ..... E05D 15/52

[52] U.S. Cl. ..... 49/192; 49/49; 49/141; 49/237

[58] Field of Search ..... 49/192, 35, 49, 141, 49/237

[56] References Cited

U.S. PATENT DOCUMENTS

| | | | |
|---|---|---|---|
| 1,535,753 | 4/1923 | Weiser | 246/128 |
| 1,716,340 | 5/1926 | Cook | 49/152 |
| 1,795,621 | 3/1931 | Sprung | 49/237 |
| 1,812,559 | 6/1928 | Sampson | 92/28 |
| 1,914,359 | 4/1930 | Butts | 49/334 |
| 1,945,295 | 6/1931 | Pranger | 49/192 |
| 2,401,275 | 4/1933 | Richards et al. | 49/334 |
| 2,735,144 | 2/1956 | Anderson et al. | 49/237 |
| 3,222,806 | 10/1963 | Martin | 2/216 |
| 3,394,498 | 7/1968 | Reinitz et al. | 49/141 |
| 4,219,969 | 9/1980 | Reinitz et al. | 49/141 |
| 4,227,344 | 10/1980 | Poppke | 49/9 |

*Primary Examiner*—Philip C. Kannan

*Attorney, Agent, or Firm*—Jacox & Meckstroth

[57] ABSTRACT

Automatically operable automotive vehicle gate apparatus provided with self protection and automotive protection. The gate apparatus includes operational mechanism which moves a gate member within a gateway between a closed position and an open position. The gate apparatus also includes structure which permits the gate member to be moved to an open position when opening forces are applied thereto, without operation of the operational mechanism. Thus, the gate apparatus is protected against damage. The gate apparatus also includes mechanism which permits the gate operation mechanism to move from an open position to a closed position while the gate member remains in an open position. Thus, if an automotive vehicle should be within the gateway when closing action of the gate operation mechanism occurs, the automotive vehicle is protected against damage.

8 Claims, 11 Drawing Figures

9
12
16
14
10
20
44
48
49
50
24
20b
32
42
70
20a
28
24a
36
36a
38
56
58
60
64
II

AUTOMATICALLY OPERABLE AUTOMOTIVE VEHICLE GATE APPARATUS PROVIDED WITH SELF PROTECTION AND AUTOMOTIVE PROTECTION

BACKGROUND OF THE INVENTION

Automatically operable automotive vehicle gates are employed to control entrance to parking areas, buildings, etc. Customarily, such a gate is operated in response to operation of a sensing device or the like. The gate customarily comprises an elongate arm which is substantially horizontal in closed position and which is angularly moved upwardly to open position.

It has been found that frequently, intentionally or accidentally, automotive vehicles engage the elongate arm to urge the gate to open position. A conventional gate arm thus is broken and must be replaced.

Another problem is created when the elongate gate arm is moved in a downwardly direction toward closed position when an automotive vehicle is in the gateway directly below the elongate arm. When this occurs, the automotive vehicle may be damaged.

It is therefore an object of this invention to provide automatically operable automotive vehicle gate apparatus which is capable of protecting itself against damage and which also protects an automotive vehicle against damage.

Other objects and advantages of this invention reside in the construction of parts, the combination thereof, the method of production and the mode of operation, as will become more apparent from the following description.

DETAILED DESCRIPTION OF THE INVENTION

Figure 1:
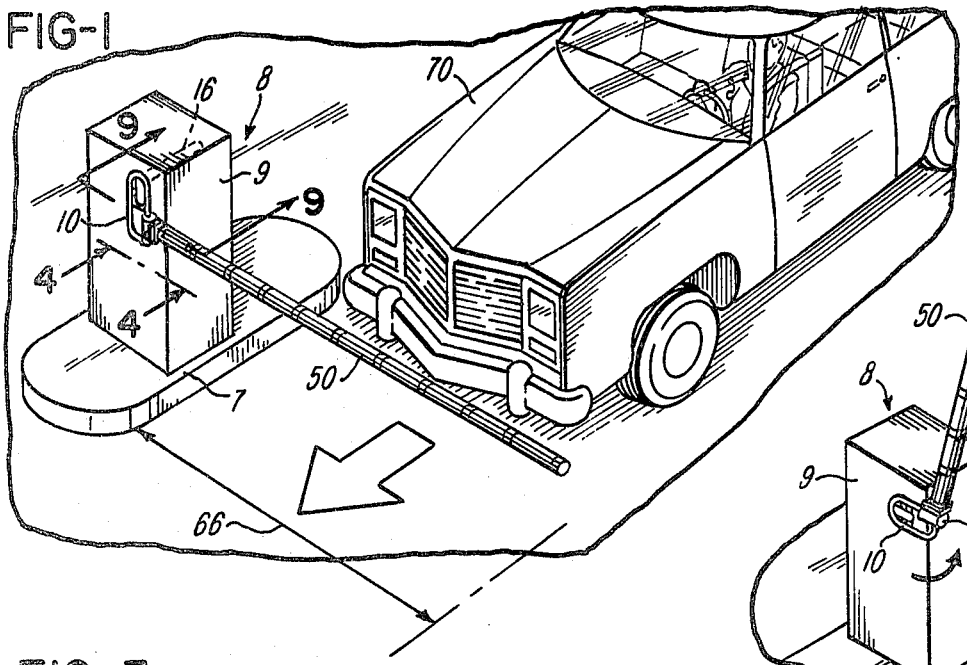
FIG. 1 is a perspective view of automatically operable automotive gate apparatus of this invention showing the gate in a closed position and showing an automotive vehicle approaching the gate.
Figure 2:
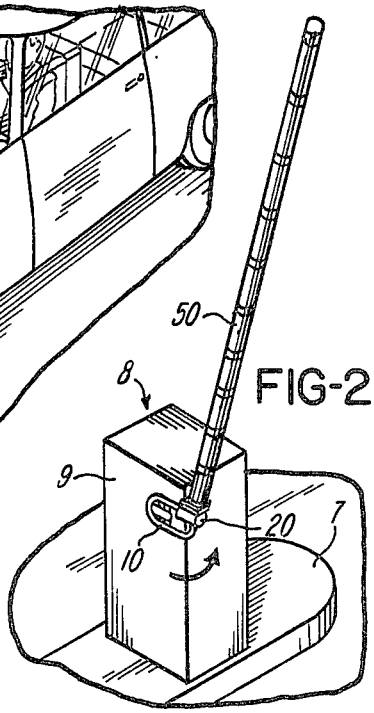
FIG. 2 is a perspective view of the gate apparatus of FIG. 1 with the gate in an open position.
Figure 3:
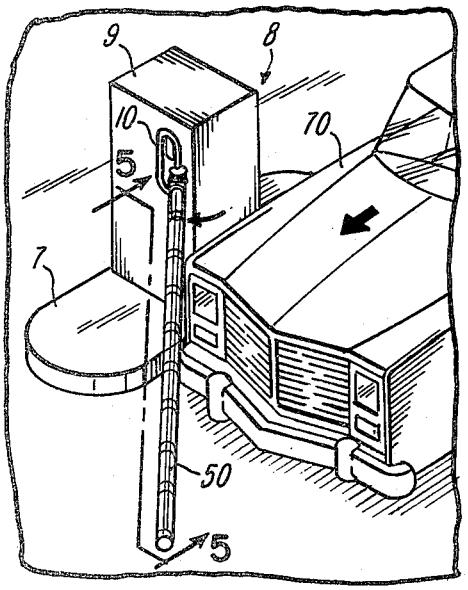
FIG. 3 is a perspective view showing the gate apparatus of FIGS. 1 and 2 as the gate is urged toward an open position by an automotive vehicle.
Figure 4:
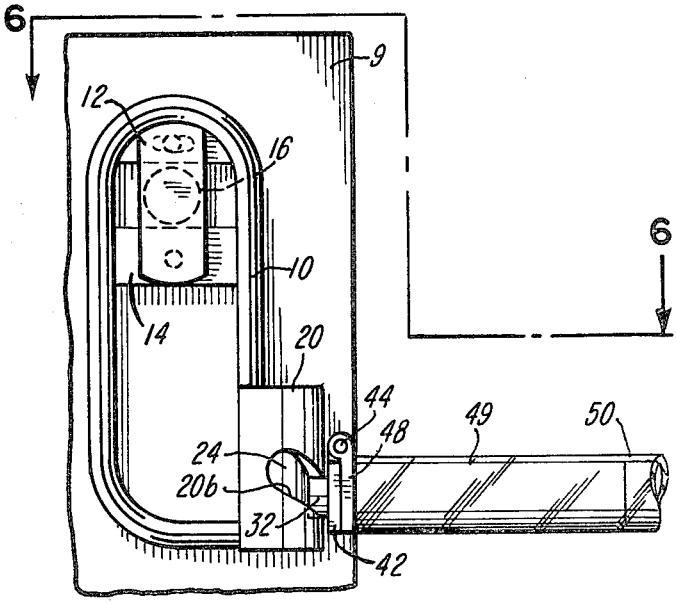
FIG. 4 is an enlarged fragmentary elevational view taken substantially on line 4—4 of FIG. 1.
Figure 5:
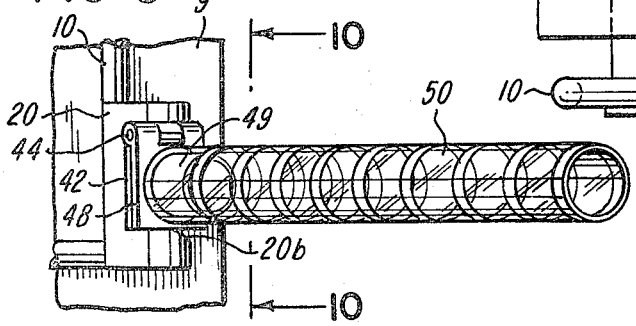
FIG. 5 is an enlarged fragmentary elevational view taken substantially on line 5—5 of FIG. 3.
Figure 6:
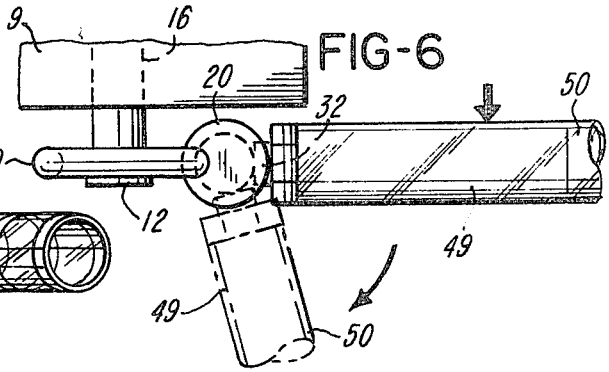
FIG. 6 is a fragmentary top view taken substantially on line 6—6 of FIG. 4.
Figures 7, 8, 9, 10, 11:
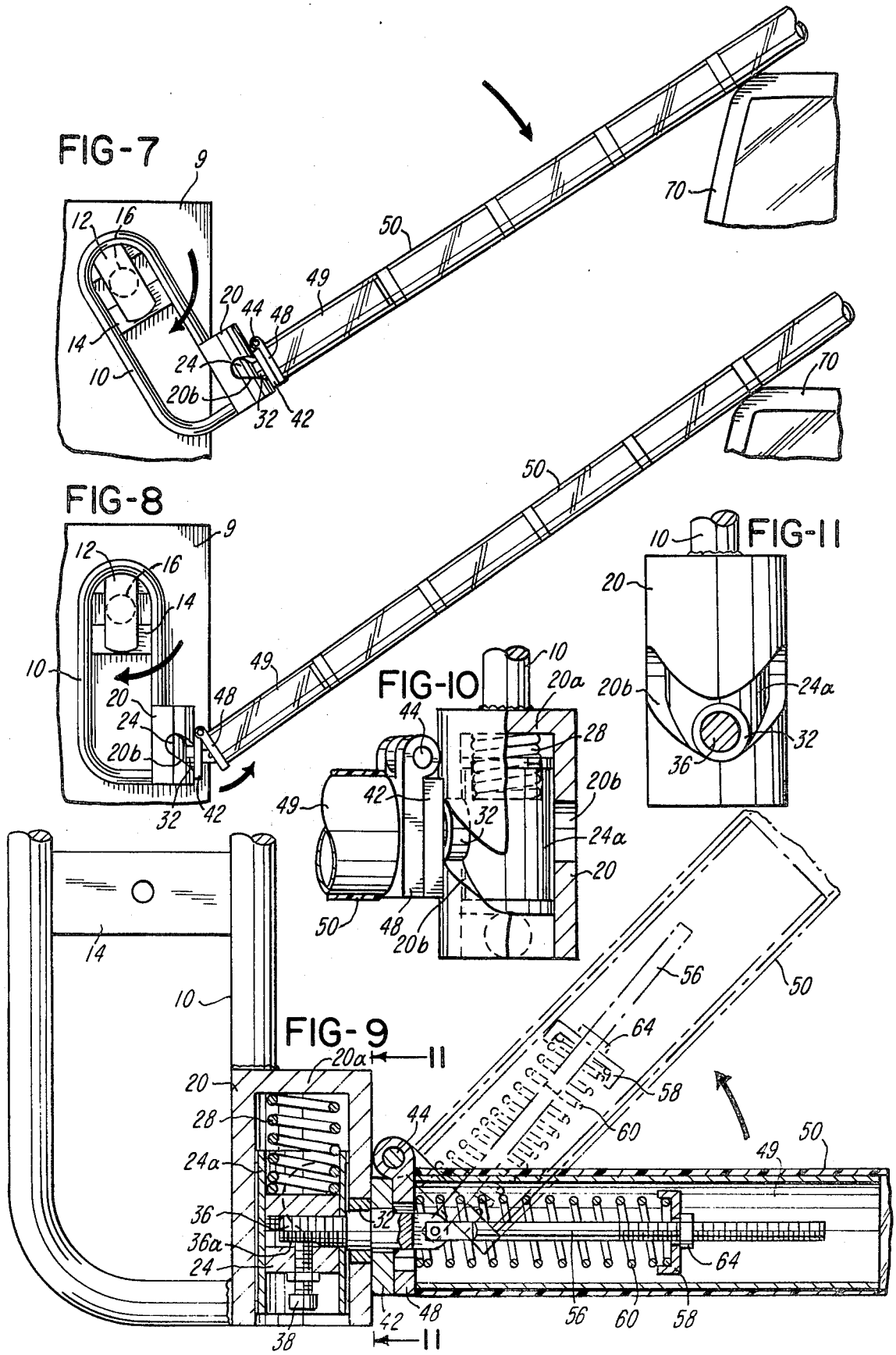
FIG. 7 is an elevational view, drawn on a slightly smaller scale than FIGS. 4–6, illustrating a gate of this invention in operation as it moves toward closed position and engages an automotive vehicle.
FIG. 8 is an elevational view, drawn on substantially the same scale as FIG. 7, illustrating the gate of FIG. 7 as the gate continues to engage an automotive vehicle, and as the gate support member moves further toward a closed condition.
FIG. 9 is an enlarged fragmentary sectional view taken substantially on line 9—9 of FIG. 1.
FIG. 10 is a fragmentary sectional view, with parts broken away, taken substantially on line 10—10 of FIG. 5.
FIG. 11 is a sectional view taken substantially on line 11—11 of FIG. 9.

Automatically operable automotive gate apparatus 8 of this invention comprises a platform 7 upon which is mounted a pedestal 9, shown in FIGS. 1, 2, and 3. A rotary shaft 16 extends from the pedestal 9 and is rotatively operated by any suitable means, not shown. A bracket 10 is attached to the rotary shaft 16, by means of connector members 12 and 14, as best illustrated in FIGS. 4, 7, and 8. Attached to the bracket 10 is a substantially cylindrical housing 20. Within the housing 20 is a connector body 24, provided with a socket portion 24*a*. A spring 28 is seated in the socket portion 24*a* and engages an end wall 20*a* of the housing 20 and urges the connector body 24 downwardly within the housing 20. The housing 20 has a generally V-shaped cam slot 20*b*, shown in FIGS. 4, 7, 8, 10, and 11, within which and along which a roller 32 is rotatively movable. A shaft or stem 36 extends through the roller 32 and is threadedly attached to the connector body 24, as best illustrated in FIG. 9, as the roller 32 is rotatable upon the shaft or stem 36. A set screw 38 extends into the connector body 24 at a right angle to the shaft or stem 36 and engages a flat portion 36*a* of the shaft or stem 36 to maintain the position of the shaft or stem 36 with respect to the connector body 24. Normally, the roller 32 is positioned in the lowermost portion of the V-shaped cam slot 20*b* as the spring 28 forces the connector body 24 downwardly.

External of the housing 20 the shaft or stem 36 has attached thereto a carrier 42 which is in juxtaposition with the housing 20. Pivotally attached to the carrier 42 by means of a pin 44 is a plate 48. Secured to the plate 48 is a short connector tube 49. A gate member 50, which is preferably an elongate tube of plastics material or the like, has an end portion closely encompassing the short connector tube 49, and the gate member 50 extends from the short connector tube 49.

The shaft or stem 36 extends freely through the plate 48 and has pivotally attached thereto a rod 56, which is positioned within the short connector tube 49. Encompassing the rod 56 is a retainer 58. A helical spring 60 encompasses the rod 56 and is compressed between the pivotal plate 48 and the retainer 58 and urges the pivotal plate 48 toward the carrier 42. Thus, the short connector tube 49 and the gate member 50, attached thereto, are urged by the helical spring 60 to a position extending axially from the stem or shaft 36. A nut 64 is threaded upon the rod 56 and engages the retainer 58 and adjustably establishes the compressed condition of the helical spring 60.

OPERATION

The gate member 50 when in a horizontal position, as illustrated in FIG. 1, extends substantially over or through a gateway 66.

FIG. 1 shows an automotive vehicle 70 as it approaches the gate member 50. The gate member 50 is movable angularly upwardly in the manner illustrated in FIG. 2 by a control unit, not shown, when the automotive vehicle 70 is sensed by a sensing device, not shown, adjacent the gateway 66 or when an attendant adjacent the gateway 66 operates the control unit. When the control unit operates, the rotary shaft 16 is rotatively moved counterclockwise and angularly moves the bracket 10 counterclockwise, as illustrated in FIG. 2. When the bracket 10 is angularly moved as shown in FIG. 2, the gate member 50 is angularly raised, as shown in FIG. 2, to permit an automotive vehicle, such as the automotive vehicle 70 to pass through the gateway 66.

However, if for some reason, intentionally or unintentionally, the automotive vehicle 70 moves forwardly and engages the gate member 50 while the gate member 50 is horizontal, a force is applied to the gate member 50. When such force is applied to the gate member 50, the gate member 50, the short connector tube 49, and the shaft or stem 36 move with respect to the housing 20. Such movement of the shaft or stem 36 occurs as the pivotal plate 48 and the carrier 42 which are supported by the shaft or stem 36, force the shaft or stem 36 to move with respect to the housing 20. When the shaft or stem 36 moves with respect to the housing 20, the roller 32 which encompasses the shaft or stem 36, rolls upwardly within the cam slot **20*b* and with respect to the housing 20, as illustrated in FIG. 10. Such movement of the roller 32 upwardly within the cam slot 20*b* forces the connector body 24 within the housing 20 to move upwardly against the compression forces of the spring 28. Thus, the gate member 50 moves to the position thereof illustrated in FIG. 3, as the automotive vehicle 70 applies a force thereto. As the automotive vehicle 70 continues to move in the direction illustrated in FIG. 3, the gate member 50 is moved to a greater angle with respect to the bracket 10**.

After the automotive vehicle 70 passes through the gateway 66 and from the gate member 50, the spring 28 within the housing 20 forces the connector body 24 to move downwardly within the housing 20, and the roller 32 is forced to move downwardly within the cam slot **20*b* to the lowermost part of cam slot 20*b*. Thus, the shaft or stem 36 returns to the normal positon thereof shown in FIG. 9, and the gate member 50 returns to the normal position thereof as illustrated in FIG. 4 and as illustrated in solid lines in FIG. 9**.

Therefore, it is understood that the gate member 50 of this invention functions to avoid damage thereto when forces are applied thereto.

In normal operation of the automotive gate apparatus 8, the rotary shaft 16 rotatively moves in a counterclockwise direction for opening operation of the gate member 50. With such rotative movement of the rotary shaft 16, the bracket 10 is angularly moved, and the gate member 50 is angularly moved upwardly as illustrated in FIG. 2. After an automotive vehicle 70 passes the gate member 50, the rotary shaft 16 is rotatively moved in a clockwise direction for closing movement of the gate member 50. Thus, the bracket 10 and the gate member 50 are angularly moved downwardly as illustrated in FIG. 7. However, if there should be an automotive vehicle 70 directly below the gate member 50, as the gate member 50 is lowered, the gate member 50 engages the automotive vehicle 70, as illustrated in FIG. 7. As the rotary shaft 16 continues to rotatively move in a clockwise direction for closing operation, the bracket 10 continues to angularly move in a clockwise direction. When this continued movement occurs, as illustrated in FIG. 8, there is pivotal movement between the pivotal plate 48 and the carrier 42, as illustrated in FIG. 8. As this pivotal movement between the pivotal plate 48 and the carrier 42 occurs, the rod 56 is pivotally moved with respect to the shaft or stem 36, as illustrated by broken lines in FIG. 9. When this pivotal movement between the shaft or stem 36 and the rod 56 occurs, compressional forces of the helical spring 60 are increased. Therefore, after the automotive vehicle 70 moves from the gateway 66 and disengages from the gate member 50, the helical spring 60 returns the rod 56 and the gate member 50 to their normal horizontal positions illustrated by solid lines in FIG. 9.

Thus, it is understood that the automotive vehicle gate apparatus of this invention functions to protect itself against damage as forces are applied thereto by an automotive vehicle 70 or the like. Furthermore, the apparatus of the automotive vehicle gate apparatus of this invention functions to protect an automotive vehicle against damage if the gate member 50 attempts to close while an automotive vehicle 70 is within the gateway 66.

Although the preferred embodiment of this invention has been described, it will be understood that within the purview of this invention various changes may be made in the form, details, proportion and arrangement of parts, the combination thereof, and the mode of operation, which generally stated consist in automotive vehicle gate apparatus within the scope of the appended claims.

The invention having thus been described, the following is claimed:

1. Automotive vehicle gate apparatus comprising:

rotary support means, a gate having a closed position and an open position, connection means joining the gate to the rotary support means for angular movement of the gate between closed position and open position with rotative movement of the rotary support means, said connection means including means for angular movement of the gate about a plurality of axes with respect to the rotary support means and including means for angular movement of the gate from the closed position thereof to the open position thereof when forces are applied to the gate, the connection means including a bracket, a housing joined to the bracket, the housing including an inclined cam surface, a roller movable upon the cam surface, a stem supported by the roller and movable therewith, and pivotal means joining the stem to the gate.

2. The automotive vehicle gate apparatus of claim 1 in which the cam surface is generally V-shaped, and includes means resiliently urging the roller and the stem toward a normal position at the lower part of the cam surface, the gate thus being in a normal horizontal closed position when the stem and roller are in the lowermost part of the cam surface, the stem and the gate while horizontal thus being movable upwardly by substantially horizontal forces applied to the gate in either of opposite directions.

3. Automotive vehicle gate apparatus comprising:

rotary operator means rotatable about a generally horizontal axis, a gate having a closed position and a plurality of open positions, connection means joining the gate to the rotary operator means for angular movement of the gate about a substantially horizontal axis between closed position and an open position with rotative movement of the rotary operator means, said connection means including means permitting angular movement of the gate about a plurality of axes from the closed position thereof to an open position thereof when forces are applied to the gate and without rotative movement of the rotary operator means, said plurality of axes including axes substantially normal one to the other, one of said axes being substantially normal to the axis of rotation of the rotary operator means and one of said axes being substantially parallel to the axis of rotation of the rotary operator means.

4. The automotive vehicle gate apparatus of claim 3 in which said connection means includes cam means joining the gate to the rotary support means.

5. The automotive vehicle gate apparatus of claim 3 in which the gate is in a generally horizontal position when in closed position and in which the connection means includes means for pivotal movement of the elongate gate within a substantially vertical plane.

6. Automotive vehicle gate apparatus of the type provided with support structure having a rotary shaft, the improvement comprising:

a bracket, means joining the bracket to the shaft for rotative movement therewith, a housing attached to the bracket and movable therewith, the housing having a generally V-shaped cam slot therein, a connection body within the housing and movable with respect thereto, a spring member within the housing and urging linear movement of the connection body, a stem joined to the connection body and extending from the housing through the V-shaped cam slot, the stem being normally at the lowermost portion of the V-shaped cam slot, the stem being movable along the V-shaped cam slot, a closure member, connector means pivotally joining the closure member to the stem, the closure member being angularly movable with rotative movement of the shaft and the bracket between a substantially horizontal closed position and an upwardly inclined open position, the closure member also being movable with respect to the housing and with respect to the bracket as pressure is applied to the closure member to move the stem along the V-shaped cam slot, the closure member through the connector member being pivotally movable with respect to the housing and bracket when pressure is applied thereto.

7. The automotive vehicle gate apparatus of claim 1 which includes spring means applying forces to the gate and to the connector means and urging the gate to a given angular position with respect to the housing and bracket.

8. The automotive vehicle gate apparatus of claim 1 which includes a roller member encompassing the stem and movable along the V-shaped cam slot with movement of the stem along the V-shaped cam slot and with movement of the connection body with respect to the housing.

* * * * *

UNITED STATES PATENT AND TRADEMARK OFFICE

CERTIFICATE OF CORRECTION

PATENT NO. : 4,364,200

DATED : December 21, 1982

INVENTOR(S) : Carl W. E. Cobb

It is certified that error appears in the above–identified patent and that said Letters Patent are hereby corrected as shown below:

Column 6, line 18, change "1" to ---6---.

Column 6, line 23, change "1" to ---6---.

Signed and Sealed this

*First* Day of *March 1983*

[SEAL]

*Attest:*

GERALD J. MOSSINGHOFF

*Attesting Officer*

*Commissioner of Patents and Trademarks*